United States Patent [19]

Roccaforte

[11] Patent Number: 4,569,443

[45] Date of Patent: Feb. 11, 1986

[54] CARTON WITH TAMPER-PROOF POURING SPOUT

[75] Inventor: Harry I. Roccaforte, Western Springs, Ill.

[73] Assignee: Champion International Corporation, Stamford, Conn.

[21] Appl. No.: 373,010

[22] Filed: Apr. 29, 1982

Related U.S. Application Data

[63] Continuation of Ser. No. 199,443, Oct. 22, 1980, abandoned, which is a continuation of Ser. No. 26,998, Apr. 4, 1979, abandoned.

[51] Int. Cl.[4] ..... B65D 5/74

[52] U.S. Cl. ..... 206/626; 206/807; 222/528; 229/17 R; 229/37 R

[58] Field of Search ..... 206/625, 626, 611, 807; 229/17 R, 37 R; 222/528, 529

[56] References Cited

U.S. PATENT DOCUMENTS

| | | | |
|---|---|---|---|
| 1,539,985 | 6/1925 | Allen | 229/17 R |
| 1,907,939 | 5/1933 | Venning et al. | 229/17 R |
| 2,019,943 | 11/1935 | Venning et al. | 229/17 R |
| 2,701,679 | 2/1955 | Goldstein | 229/17 R |
| 2,742,220 | 4/1956 | Lynes | 229/17 R |
| 2,760,708 | 8/1956 | Phillips | 229/17 R |
| 3,568,910 | 3/1971 | McConnell | 229/17 R |
| 4,054,240 | 10/1977 | LaPierre | 229/17 R |
| 4,150,778 | 4/1979 | Engdahl, Jr. | 229/17 R |

FOREIGN PATENT DOCUMENTS

| | | | |
|---|---|---|---|
| 546884 | 10/1957 | Canada | 229/17 R |

*Primary Examiner*—Allan N. Shoap

*Attorney, Agent, or Firm*—Evelyn M. Sommer; John H. Mulholland; William W. Jones

[57] ABSTRACT

A blank for forming a carton with integral tamper-proof pouring spout, the method of forming the carton, and the resultant carton, said carton comprising first and second side wall panels, first and second end wall panels hingedly connected to said first and second side wall panels, and top and bottom closure panels attached to said side wall panels to form a tubular carton of rectangular cross-section, one of said wall panels of said erected carton including an inner and outer panel having a dispensing opening with a pouring spout formed therethrough being movable from a closed to an open position, and an access tab located above and immediately adjacent to said pouring spout and removably attached to said outer panel and said pouring spout to prevent opening of said spout until said access tab is removed.

7 Claims, 14 Drawing Figures

CARTON WITH TAMPER-PROOF POURING SPOUT

This is a continuation of application Ser. No. 199,443 filed Oct. 22, 1980, now abandoned, which is a continuation of Ser. No. 26,998, filed Apr. 4, 1979, now abandoned.

BACKGROUND OF THE INVENTION

The present invention relates to paperboard cartons and more particularly to cartons having an integral pouring spout through which the contents of the carton may be dispensed.

Numerous types of pouring spout structures have hitherto been proposed for this purpose, but they have not been entirely satisfactory. One problem relates to the gluing techniques required to form cartons containing pouring spouts and the speed at which the glue can be applied to the carton blank. In producing the prior art cartons, the glue can be applied only in certain places on the blank and this requires a timed operation on the gluer controls limiting the speed at which glue can be applied to the carton blanks because the glue pattern of the glue applicator wheel has to correspond precisely at a given location on a carton blank.

Further, pouring spouts in known prior art dispensing cartons do not have a means associated therewith whereby opening or tampering with the spout can be readily detected. In such cartons, the pouring spout can be opened and closed and contents of the carton removed without detection except by actually inspecting the contents of the carton. With some present cartons, a protective covering such as a label must be placed over the pouring spout area on the outside of the carton in an effort to forestall tampering.

Also, the pouring spout side walls or wings of the prior art cartons have associated therewith abutments to limit the distance the spout can be removed from the carton. These abutments cause resistance in pulling out the pouring spout at the point where the arc of the wing meets the angle of the abutments. In addition, in some embodiments, a scrap area must be removed from the carton blank in order to allow the side wall wing of the pouring spout on which is located the abutment to be moved with the spout from a closed to an open position.

In some cartons, especially those made of heavy caliper boards, it is difficult to grasp the spout to pull it out and either fingernails are damaged or some sharp device must be inserted behind the spout to remove it from the carton.

Also, prior art carton spouts are small in size and, because they are located on the carton end wall panels, are limited in width to the width of the end wall panel.

SUMMARY OF THE INVENTION

The present invention overcomes the problems of the prior art and provides cartons with integral pouring spouts that can be produced in a rapid, efficient, and economical manner and which have tamper-proof pouring spouts.

Briefly stated, the present invention comprises a blank for forming a carton and the resultant carton, said carton comprising first and second side wall panels, first and second end wall panels hingedly connected to said first and second side wall panels to form a tubular carton of rectangular cross-section, one of said wall panels of said erected carton comprising an inner and an outer panel having a dispensing opening with a pouring spout formed therethrough being movable from a closed to an open position, and an access tab located above and immediately adjacent to said pouring spout and removably attached to said outer panel and said pouring spout to prevent opening of said spout until said access tab is removed.

Also, the invention comprises the method of applying glue to a carton blank having a glue flap and an end wall in juxtaposed relationship and forming a body wall, said method comprising the steps of applying means to predetermined areas of said carton blank subject to glue application to prevent glue from adhering thereto, and applying glue to successive blanks including said predetermined areas in a continuous, untimed manner.

BRIEF DESCRIPTION OF THE DRAWINGS

These and other objects and advantages of the present invention will be disclosed in the course of the following specification, reference being had to the accompanying drawings in which.

DESCRIPTION OF THE PREFERRED EMBODIMENT

Figure 1:
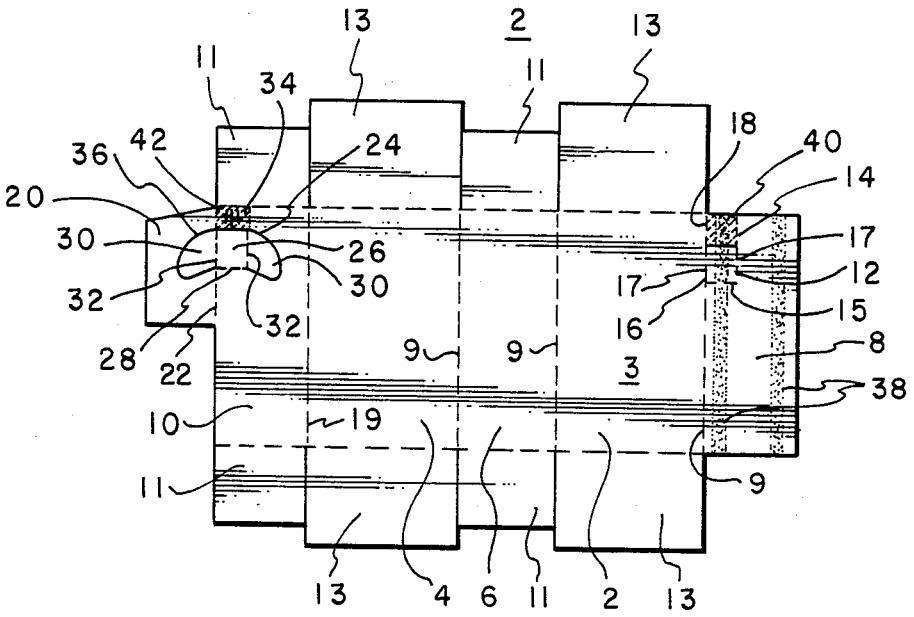
FIG. 1 is a plan view of a carton blank incorporating a pouring spout in accordance with the present invention.

Referring now to FIG. 1 which illustrates the carton blank of the preferred embodiment for forming a pouring spout carton in accordance with the present invention, the carton blank, indicated generally at 2, will be formed from conventional paperboard or boxboard of any desired caliper. A typical use of such cartons is the packaging of detergents where the contents can be dispensed from time to time through the pouring spout.

Blank 2 is cut and scored to define first and second side wall panels 3 and 4, respectively, a first end wall panel 6 hingedly connecting said side wall panels 3 and 4, a glue flap 8 hingedly connected to the remaining edge of the first side wall panel 3, and a second end wall panel 10 hingedly connected at 19 to the remaining edge of said second side wall panel 4 whereby a tubular carton of rectangular cross-section is obtained when erected. Also, hingedly attached to side walls 3 and 4 are top and bottom closure panels 13 and hingedly attached to end wall 6 and end wall 10 are top and bottom closure flaps 11. Formed in glue flap 8 is a generally rectangular pouring spout tab 12 which is hingedly connected at its base 15 to glue flap 8 and held in place by slight interruptions or "nicks" 17 in the line of cut defining the border of said tab. One of the side edges 16 of tab 12 lies along the line of articulation or hinge 9 between first side wall 3 and glue flap 8.

It is intended that the present invention provide a convenient means by which it can be readily determined whether or not tampering with the carton and its contents has taken place. This is accomplished by providing a removable access tab above and immediately adjacent to the pouring spout and removably attached to the carton panel and the pouring spout to prevent opening of the spout until the access tab is removed.

Thus, an access tab 14 is located above and immediately adjacent said pouring spout tab 12 and is removably attached to said glue flap 8 and said pouring spout tab 12 to prevent opening of the pouring spout until the access tab is removed. Tab 14 is held in place by perforations 18 which are easily torn and thus allow removal of tab 14. Not only does such access tab provide a means by which tampering of the carton spout can be detected, but it also eliminates the necessity of stripping out an area immediately above and adjacent to the pouring spout to allow easy access. Some die cutting machines cannot strip a small hole and such operation would necessitate a separate action which adds cost to the production of the carton.

In addition to assuring the consumer that the package contents are intact, the access tab retards, if not entirely prevents, moisture from reaching the product since there is no hole to the outer surface. Further, in some cases the access tab eliminates the need of a protective label over the pouring spout area on the outside of the package.

The present invention also eliminates the resistance to pulling out the pouring spout caused by the abutments on the wings of the prior art pouring spout. This problem is eliminated by allowing the two wings to follow an unbroken arcuate path beyond 90° from a vertical position. Thus, there is no interference between abutments and the carton wall from which the wing is formed. When the spout is pulled out of the carton, it has sufficient material extending the side walls inside the carton to allow the user to regulate the portion of the spout needed. A sufficient amount of friction is obtained by the travel of the arcs in contact with the top edge of the straight portion of the carton.

Thus, wall extension 20 is hingedly connected at 22 to the outer side edge of second end wall panel 10. A pouring spout 24 is formed in part in said end wall 10 and in part in said wall extension 20 and comprises a generally rectangular center part 26 hingedly connected at its base 28 to end wall panel 10. Side walls or wings 30 are hingedly attached at 32 to each side of said center part 26 and extend to each side thereof. Each of said wings or side walls 30 is generally in the shape of a quarter circle whose unbroken arc extends beyond 90° from the vertical and is so dimensioned as to completely close the opening sides of the dispensing opening formed by pouring spout tab 12 with side walls from the top to the bottom. Further, with this type of wing, no scrap area has to be removed immediately adjacent the wings or pouring spout side walls to enable the spout to be removed from the carton thus providing, in the blank, a continuous panel surface about the pouring spout which gives better control on the gluing machine at the time the carton blank is being processed.

Also, the carton is so constructed that the pouring spout can be more easily opened or pulled out of the carton. This is accomplished by placing a series of substantially vertical slits in the panel immediately above the spout so that when the finger is inserted, the slits allow the finger to penetrate the carton and get behind the spout to open it. When the spout is closed, the slits return to their normal position, thus closing the carton.

Figure 6:
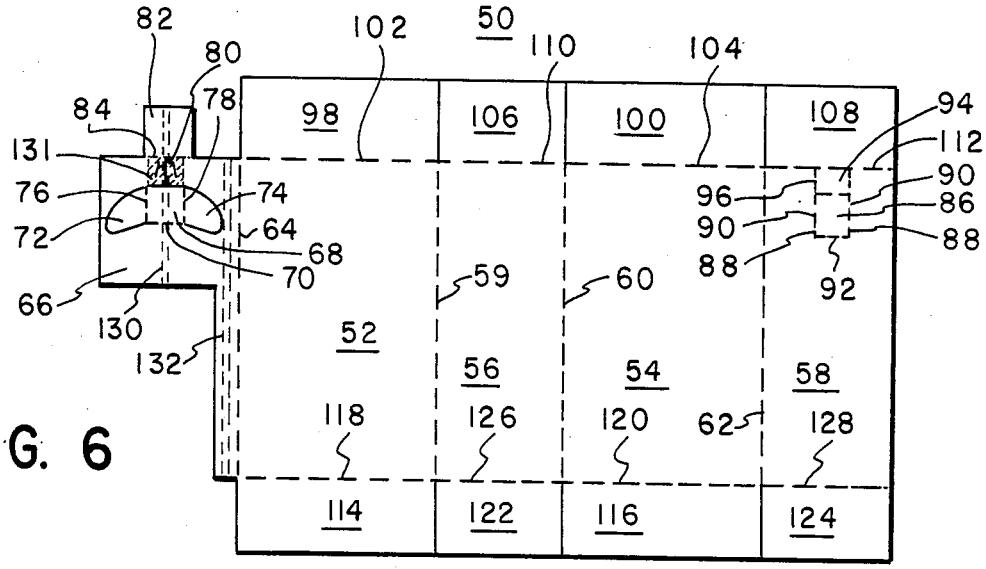
FIG. 6 is a plan view of a second embodiment of a carton blank incorporating a pouring spout in accordance with the present invention.

As can be seen in FIG. 1, generally vertically extending slits 34 are positioned immediately above the center part 26 of pouring spout 24 and are generally in the vertical position with at least one of said slits 34 extending into the cut 36 immediately above central part 26 of spout 24. These slits enable easy access to the fingernail or other sharp device to pull out the pouring spout when the carton is formed as will be shown later. The two outer slits may extend downwardly and outwardly away from the center slit as shown. They may also extend downwardly and slope inwardly toward the center slit as shown in FIG. 6; however, the outward slope is preferable.

Timed operations on the gluing machine control the speed at which carton blanks can pass through the gluing machine because the glue pattern of the glue applicator wheel has to correspond precisely at a given location in a given carton. The present invention obviates the necessity of applying glue in particular locations on the cartons and thus does away with the control factor and enables the speed of the gluing machine to be increased, and hence, more cartons per hour can be glued. In the present invention, the gluing panel is unobstructed by any other portion not requiring glue and, therefore, timed operations are unnecessary.

Glue is applied in strips to glue flap 8 along paths 38 before folding of the carton blank. As will be shown hereinafter, when the carton is folded, pouring spout tab 12 lies above and is contiguous with central part 26 of pouring spout 24. Likewise, access tab 14 will be immediately above and covering slits 34. It is imperative that pouring spout tab 12 be glued to center part 26 of spout 24. However, because it is necessary to remove access tab 14 to expose slits 34 for the purpose of inserting the fingernail or other object to remove the spout 24, it is desirable that access tab 14 not be glued to the area where slits 34 are located. This would be accomplished in the prior art by having a glue applicator wheel apply glue to glue flap 8 only in those areas where desired. However, the close tolerance required between the glue applicator wheel and the carton itself significantly reduces the speed at which cartons can be processed. Therefore, to obviate that problem in the present invention, means such as printing ink or varnish is applied to the shaded area 42 encompassing slits 34 and the upper edge of central part 26 of the pouring spout. Since inks and varnish repel adhesive, the glue will not stick to the shaded area 42 or cause center part 26 to adhere to end wall panel 10 even though glue is applied thereto by the folding of glue flap 8 over end wall panel 10.

In some cases where the glue cannot be repelled with ink and varnish such as with polycoated board, access tab 14 is positioned as shown in FIG. 1 and cuts are made into the board surrounding the area 42 on end wall 10 which penetrate into the board at least 50%. During the gluing and folding operation, tab 14 is glued to the area immediately above slits 34 and when the tab 14 is removed the adhered 50% cut area on end wall 10 will peel off with it thus exposing a thin layer of material over the slits 34. This thin layer of material can be easily penetrated to allow the slits 34 to be effective and cause easy access to get behind spout 24 and pull it out.

Figure 2:
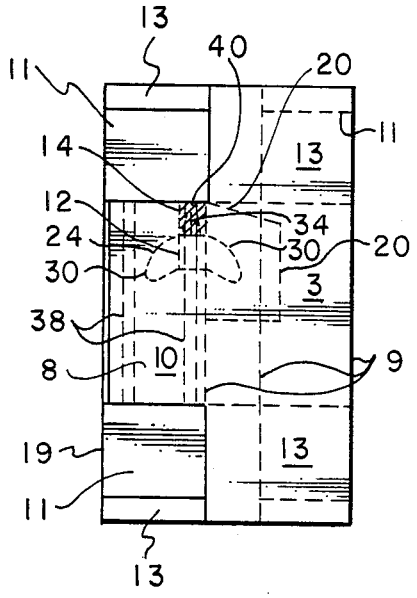
FIG. 2 is a plan view of the folded and tubed blank.

FIG. 2 is a plan view of the folded carton blank. End wall 10 is first end folded about line 19 in FIG. 1. Thus, it overlaps side wall panel 4 and partially extends over end wall 6. Next, side wall panel 3 and attached glue flap 8 are folded about articulation 9 and overlap end panel 6 and part of side panel 4 and entirely covers wall extension 20. In this overlapped position, pouring spout tab 12 lies immediately above and contiguous to central part 26 of pouring spout 24 and is glued thereto by the glue on strip 38. Likewise, easy access tab 14 is positioned above and surrounding slit 34 but the glue applied thereto does not adhere because of the ink or varnish 42 (shaded area) applied thereto. Thus, when the access tab 14 is removed, it does not stick to the area it covers.

In this folded state, the carton can be shipped to the user thereof who will erect it and by folding inwardly bottom and top panels 11 and 13, a carton of substantially rectangular shape is formed.

Figure 3:
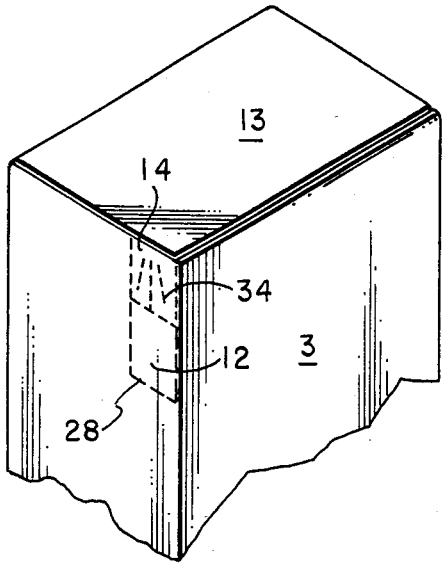
FIG. 3 is a fragmentary perspective view illustrating the carton with its spout and access tab intact.

The erected carton is shown in FIG. 3 and shows the carton with the access tab 14 in place and the spout 24 in its closed position and covered with superimposed spout tab 12. Slits 34 are covered by access tab 14.

Figure 4:
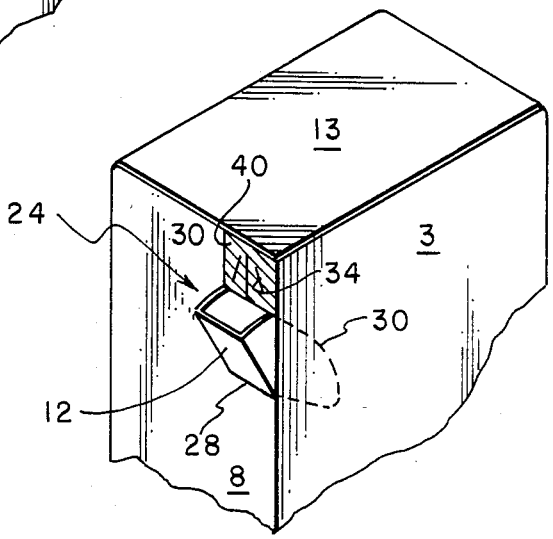
FIG. 4 is a fragmentary perspective view similar to FIG. 3 in which the access tab has been removed and the pouring spout in its open position.

FIG. 4 is a fragmentary perspective view illustrating the carton with its spout in the open position. In this state, easy access tab 14 has been removed exposing the area in which ink or varnish 42 has been previously applied to prevent glue from adhering thereto. Further, in this area slits 34 can be seen which enable the finger or other object to be inserted into the carton to grasp the top of spout 24 and pull the top thereof out of the carton. As can be seen in FIG. 4, pouring spout tab 12, when glued to central part 26 of spout 24, has attached to each side thereof wings or side walls 30 which extend from the bottom to the top of the rectangular opening formed by pouring spout tab 12.

Figure 5:
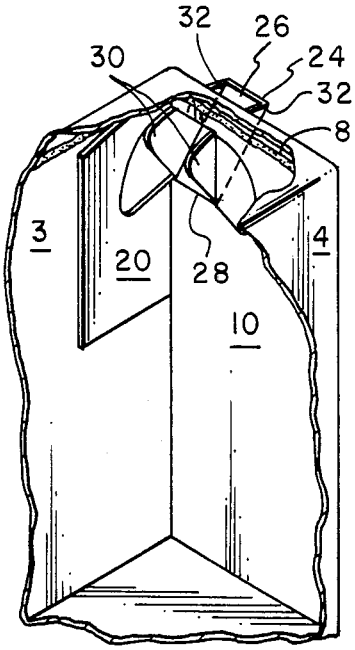
FIG. 5 is a fragmentary perspective view with parts broken away illustrating the manner in which the side forming wings of the spout engage the inner surfaces of the carton when the spout is opened without the use of abutments thereon.

FIG. 5 is a fragmentary perspective view of the inside of the novel carton illustrating the manner in which the parts interrelate when the spout is in a partially open position. In this view, the central part 26 and wings 30 of spout 24 can be seen as the spout 24 is pivoted about base 28 and the top of the spout moved outwardly from the carton. One wing 30 has moved out of wall extension 20 and the other wing 30 has moved out of end wall 10 and has pivoted about hinge axis 32. Wall extension 20 can be seen to rest against side wall 3 and glue flap 8 is on the outside overlapping end wall 10.

The carton blanks may be shipped to the user in the folded condition illustrated in FIG. 2. The user will then erect the carton to its rectangular shape and close and seal end closures 11 and 13 on one end of the carton and thereafter introduce the contents of the carton from its open end and then that end will have its end flaps 11 and 13 closed and sealed thus enabling the carton to appear as shown in FIG. 3.

When it is needed to dispense the contents, the user simply uses his fingernail or other sharp object to remove easy access tab 14 and then pressing his finger or other sharp object through slits 34 behind pouring spout 24 and pulling outward causes spout 24 to pivot about hinge line 28. The spout is thus extended to the open position as shown in FIG. 4.

FIG. 6 is a plan view of an alternate embodiment of the carton blank incorporating a pouring spout in accordance with the present invention. In this embodiment, the pouring spout with extended wings is centrally located in the glue flap and does not require an extension in which to form one of the wings. This embodiment is especially useful in larger type cartons having wide end panels. In FIG. 6, it can be seen that carton blank 50 comprises a first side wall 52, a second side wall 54, and a first end wall panel 56 connecting side wall panels 52 and 54 at articulations or hinges 59 and 60. Hingedly connected to the remaining edge of side wall 54 at 62 is second end wall panel 58.

Hingedly attached to the remaining edge of first side wall 52 at 64 is glue flap extension 66. Integrally formed in said glue flap extension 66 is a generally rectangular central part 68 of a pouring spout which is hingedly attached at its base 70 to glue flap extension 66. Wings 72 and 74 are hingedly attached to the rectangular central part 68 at 76 and 78, respectively. Each of said wings is generally in the shape of a quarter circle whose unbroken arc extends beyond 90° from the vertical. Generally vertically extending slits 80 are located in said flap extension immediately above rectangular central part 68. Tab 82 is also hingedly connected at 84 to glue flap extension 66.

Second end panel 58 has therein a generally rectangular pouring spout tab 86 with either side 88 thereof defined by a line of cut which may have a slight interruption or nick as indicated at 90 to hold the tab in place until it is displaced outwardly at which time the interruption breaks away and the tab pivots outwardly along the base line of articulation 92. Access tab 94 is located above and immediately adjacent said pouring spout tab 86 and removedly attached to said second end wall 58 and said pouring spout tab 86 to prevent opening of said spout until the access tab 94 is removed. Perforations 96 hold access tab 94 in place until it is displaced outwardly thus breaking the perforations.

Also hingedly attached to the top of side wall panels 52 and 54 at articulations 102 and 104, respectively, are top closure panels 98 and 100, respectively. Top closure panels 106 and 108 are coupled to end wall panels 56 and 58, respectively, at articulations 110 and 112, respectively. In like manner, bottom closure panels 114 and 116 are hingedly coupled to the bottom of side wall panels 52 and 54 at articulations 118 and 120, respectively. Also bottom wall closure panels 122 and 124 are hingedly connected to end wall panels 56 and 58 at articulations 126 and 128, respectively.

When the carton is folded, glue flap extension 66 will lie directly under end panel 58 and access tab 94 will be positioned and superimposed directly over vertical slit 80 and rectangular pouring spout tab 86 will be directly superimposed and positioned over pouring spout rectangular central part 68. Glue lines 130 and 132 are indicative of the location on which the gluing machine will deposit glue on glue flap extension 66 on the side opposite that shown in FIG. 6 prior to the folding of said cartons. It will be noticed that glue line 130 crosses the area encompassing vertical slit lines 80. If the glue is applied as shown and the carton folded, easy access tab 94, which is superimposed directly above the area encompassing slit lines 80 would be glued to the area containing slits 80. Since this is not desired, varnish or ink is applied to the shaded area 130 encompassing vertical slit lines 80 prior to the application of the glue. Since ink or varnish will repel glue, when the carton is folded, easy access tab 94 will not be glued to the area 130.

Figure 7:
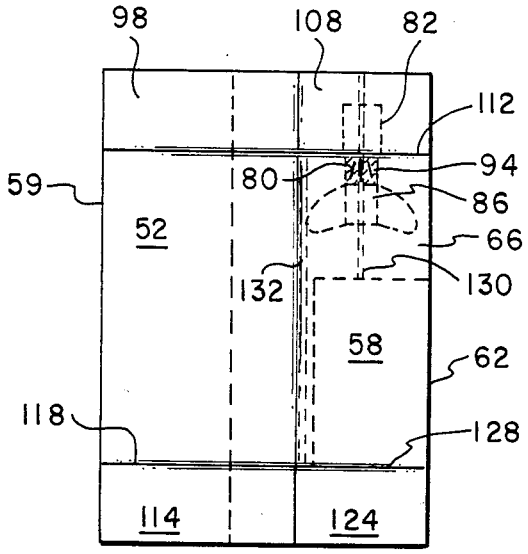
FIG. 7 is a plan view of the folded and tubed blank of the second embodiment.

FIG. 7 is a plan view of the folded carton blank of the second embodiment. The first step is to fold side wall panel 52 and associated glue flap 66 inwardly about articulation line 59 thus overlapping end panel 56 and part of side panel 54. Next, second end panel 58 is folded inwardly about articulation line 62. This causes end wall panel 58 to overlap glue flap extension 66 and superimpose easy access tab 94 over vertical slits 80 and to superimpose rectangular pouring spout tab 86 over the glue previously applied along glue line 130 which causes glue flap 66 to adhere to the inside of end wall panel 58. At the same time, pouring spout tab 86 is glued in its superimposed position to the rectangular center part 68 of the pouring spout. However, because of the ink or varnish applied to the outside of extended flap 66 in the area 130 about vertically extended slit lines 80, easy access tab 94 is not glued thereto but superimposed upon area 130. Tab 82 is, however, glued to upper closing panel 108. The glue on the other glue line 132 completes the gluing of extended flap 66 to end wall panel 58.

Figure 8:
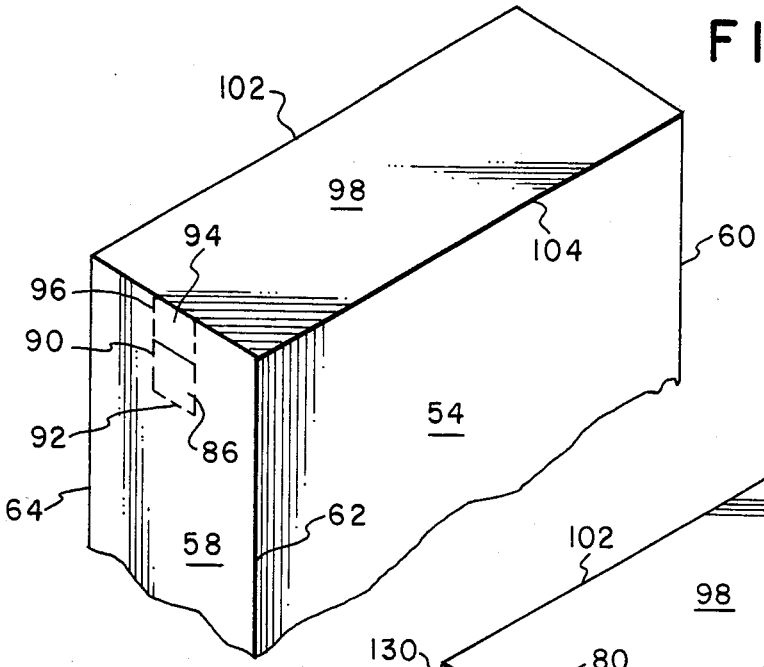
FIG. 8 is a perspective view of the second embodiment illustrating the carton in fully erected condition with the pouring spout closed.

In this position, the carton blanks may be shipped to the packager where the carton bodies are erected whereupon one of the end closures will be closed and sealed, the contents introduced into the carton from the other open end and then the remaining end closure flaps will be closed and sealed and the carton brought to its condition as shown in FIG. 8.

FIG. 8. is a perspective view illustrating the carton of the second embodiment in fully erected condition with the pouring spout closed. In FIG. 8, there can be seen easy access tab 94 and pouring spout tab 86. When it is desired to dispense the contents of the carton, the user engages the upper edge of the easy access tab 94 either with a fingernail or a sharp object and tears tab 94 from the perforations 96 which hold the tab in place until the carton is ready for use. Once the easy access tab 94 has been removed, the end of the finger or a sharp object can be inserted into the carton through vertical slits 80 and, by catching the top edge of spout tab 86, the spout can be pulled outwardly and it pivots about hinged base 92 and the interruptions 90 in the line of cut about tab 86 are torn loose and the spout pivots outwardly to the position as shown in FIG. 9.

Figure 9:
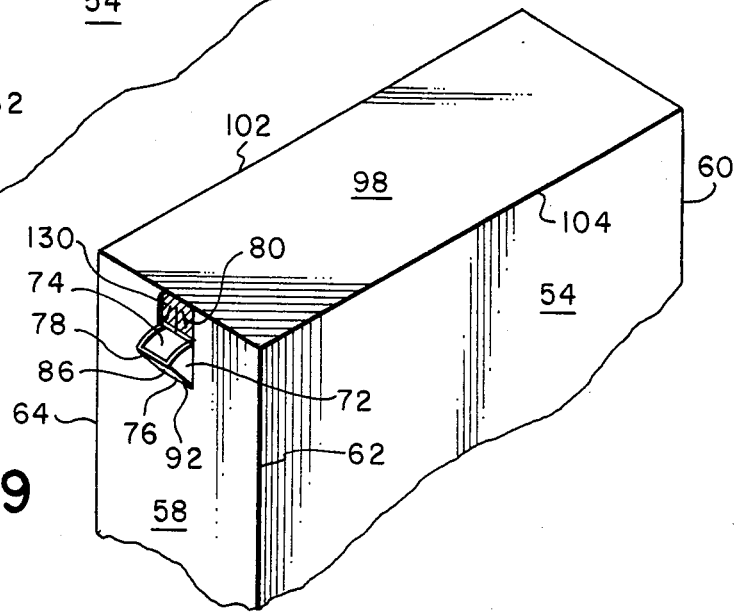
FIG. 9 is a fragmentary perspective view similar to FIG. 8 illustrating the carton of the second embodiment with its spout in a partially opened position.

FIG. 9 is a fragmentary perspective view illustrating the carton with its pouring spout in a partially opened position. In FIG. 9 can be seen pouring spout tab 86 which is superimposed upon and glued to rectangular center part 68 of the pouring spout. The spout is pivoted about and hingedly connected to end wall panel 58 at articulation 92. Wings 72 and 74 form the side walls of the pouring spout and are hingedly connected to and folded back along articulations 76 and 78, respectively. The area 130 to which the varnish or ink is applied, and which repels the glue thus preventing access tab 94 from adhering thereto, contains generally vertical slit lines 80. Upon removal of the easy access tab 94, the vertical slit lines 80 are exposed and enable the user to insert the end of the finger or a sharp object into the carton to grasp the upper edge of the pouring spout and pull it outwardly from the carton while pivoting it about hinge line 92. When sufficient amounts of the carton contents have been removed, the user merely pushes the front of pouring spout tab 86 and the spout pivots about hinge line 92 and returns to the normally closed position thus sealing the carton once again. Further, once the finger or sharp object has been removed from slits 80, the slits return to their normal position thus sealing the carton and preventing loss of the contents thereof.

Figure 10:
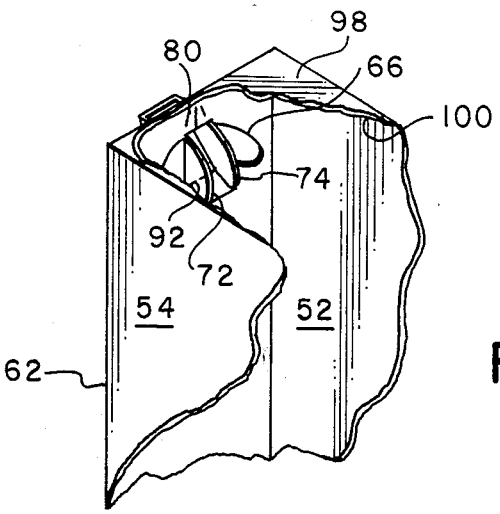
FIG. 10 is a fragmentary perspective view of the second embodiment with parts broken away to illustrate the manner in which the novel side forming wings of the spout engage the inner surfaces of the carton when the spout is opened.

FIG. 10 is a fragmentary perspective view illustrating the manner in which the parts of the carton cooperate to form a spout with side walls when the spout is moved to its open position. As can be seen in FIG. 10, when the pouring spout is pulled outwardly by grasping spout tab 86 at the top thereof, the wings 72 and 74 are forced outwardly from extended flap 66 by pivoting about articulation lines 76 and 78 (see FIG. 6). Thus, in the vertical position, wings 72 and 74 become the side walls for the pouring spout. As can be seen in FIG. 9, wings or side walls 72 and 74 extend from the top to the bottom of the rectangular pouring spout opening thus providing full depth side walls for the pouring spout. Also located immediately above the rectangular spout opening are vertical slit lines 80.

Obviously the embodiments of FIG. 1 and FIG. 6 have pouring spouts the size of whose openings are limited to the width or thickness of the cartons. In other words, in FIG. 1, the pouring spout opening could be no larger than the width of end wall panel 10. It may be desirable to provide a pouring spout of larger width. This may be achieved by placing the pouring spout on the side wall of the carton embodiment shown in FIGS. 11, 12, 13 and 14. In this embodiment, the pouring spout opening can be as wide as the side wall.

Figure 11:
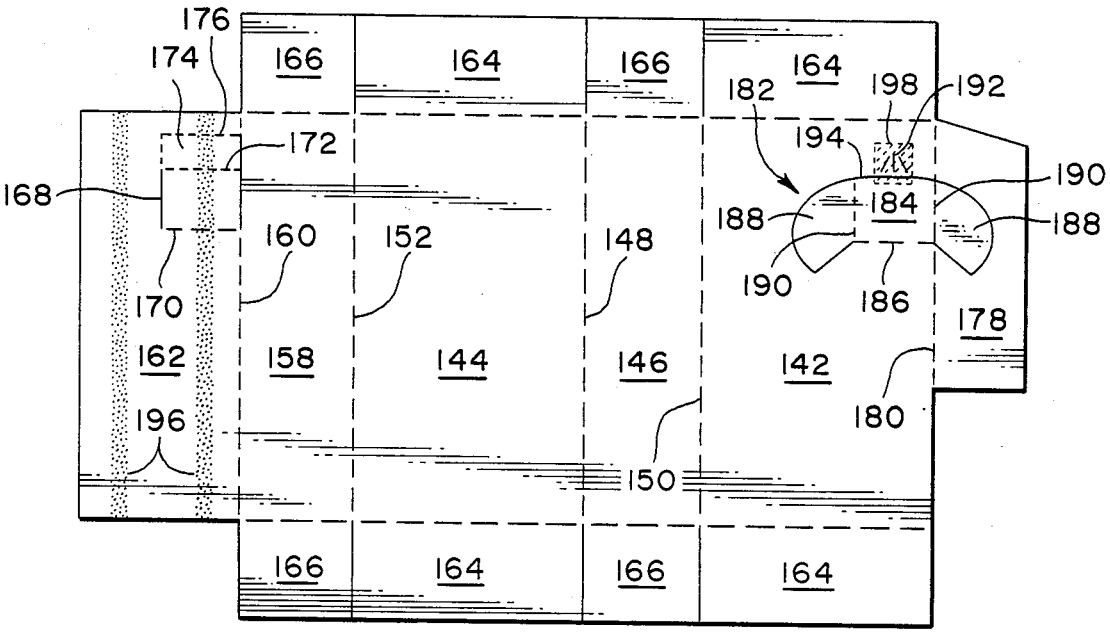
FIG. 11 is a plan view of a third embodiment of a carton blank incorporating a pouring spout on a carton side wall panel in accordance with the present invention.

In FIG. 11 blank 140 is cut and scored to define first and second side wall panels 142 and 144, respectively, a first end wall panel 146 hingedly connecting said side wall panels 142 and 144, a second end wall panel 158 hingedly connected to the remaining edge 152 of the second side wall panel 144, and a glue flap 162 hingedly connected at 160 to the remaining edge of said second end wall panel 158 whereby a tubular carton of rectangular cross-section is obtained when erected. Also, hingedly attached to side walls 142 and 144 are top and bottom closure panels 164 and hingedly attached to end wall 146 and end wall 158 are top and bottom closure flaps 166. Formed in glue flap 162 is a generally rectangular pouring spout tab 168 which is hingedly connected at its base 170 to glue flap 162 and held in place by slight interruptions or "nicks" 172 in the line of cut defining the top of said tab. One of the side edges of tab 168 lies along the line of articulation or hinge 160 between second end wall 158 and glue flap 162.

It is intended in this embodiment also that the present invention provide a convenient means by which it can be readily determined whether or not tampering with the carton and its contents has taken place. This is accomplished, as disclosed for the other embodiments, by providing a removable access tab above and immediately adjacent to the pouring spout and removably attached to the carton panel and the pouring spout to prevent opening of the spout unitl the access tab is removed.

Thus, an access tab 174 is located above and immediately adjacent said pouring spout tab 168 and is removably attached to said glue flap 162 and said pouring spout tab 168 to prevent opening of the pouring spout until the access tab is removed. Tab 174 is held in place by perforations 172 and 176 which are easily torn and thus allow removal of tab 174.

A wall extension 178 is hingedly connected at 180 to the outer side edge of first side wall panel 142. A pouring spout 182 is formed in part in said side wall 142 and in part in said wall extension 178 and comprises a generally rectangular center part 184 hingedly connected at its base 186 to side wall panel 142. Side walls or wings 188 are hingedly attached at 190 to each side of said center part 184 and extend to each side thereof. Each of said wings or side walls 188 is generally in the shape of a quarter circle whose unbroken arc extends beyond 90° from the vertical and is so dimensioned as to completely close the opening sides of the dispensing opening formed by pouring spout tab 168 with side walls from the top to the bottom. Further with this type of wings, no scrap area has to be removed immediately adjacent the wings or pouring spout side walls to enable the spout to be removed from the carton thus providing, in the blank, a continuous panel surface about the pouring spout which gives better control on the gluing machine at the time the carton blank is being processed.

Again, the carton is so constructed that the pouring spout can be more easily opened or pulled out of the carton. This is accomplished by placing the series of substantially vertical slits in the panel immediately above the spout so that when the finger is inserted, the slits allow the finger to penetrate the carton and get behind the spout to open it. When the spout is closed, the slits return to their normal position, thus closing the carton.

As can be seen in FIG. 11, generally vertically extending slits 192 are positioned immediately above the center part 184 of pouring spout 182 and are generally in the vertical position with at least one of said slits 192 extending into the cut 194 immediately above central part 184 of spout 182. These slits enable easy access to the fingernail or other sharp device to pull out the pouring spout when the carton is formed as was previously shown. The two outer slits may extend downwardly and outwardly away from the center slit as shown. They may also extend downwardly and slope inwardly toward the center slit; however, the outward slope is preferable.

Glue is applied in strips to glue flap 162 along paths 196 before folding of the carton blank. As will be shown hereinafter, when the carton is folded, pouring spout tab 168 lies above and is contiguous with central part 184 of pouring spout 182. Likewise, access tab 174 will be immediately above and covering slits 192. It is imperative that pouring spout tab 168 be glued to center part 184 of spout 192. However, because it is necessary to remove access tab 174 to expose slits 192 for the purpose of inserting the fingernail or other object to remove the spout 192, it is desirable that access tab 174 not be glued to the area where slits 192 are located. Therefore, means such as printing ink or varnish is applied on the opposite side of carton blank 140 shown in FIG. 11 to the shaded area 198 encompassing slits 192 and the upper edge of central part 184 of the pouring spout 182. Since inks and varnish repel adhesive, the glue will not stick to the shaded area 198 or cause center part 184 to adhere to side wall panel 142 even though glue is applied thereto by the folding of glue flap 162 over side wall panel 142.

Again, in those cases where the glue cannot be repelled with ink and varnish such as with polycoated board, access tab 174 is positioned as shown in FIG. 11 and cuts are made into the board surrounding the area 198 on side wall 142 which penetrate into the board at least 50%. During the gluing and folding operation, tab 174 is glued to the area immediately above slits 192 and when the tab 174 is removed, the adhered 50% cut area on side wall 142 will peel off with it thus exposing a thin layer of material over the slits 192. This thin layer of material can be easily penetrated to allow the slits 192 to be effective and cause easy access to get behind spout 182 and pull it out.

Figure 12:
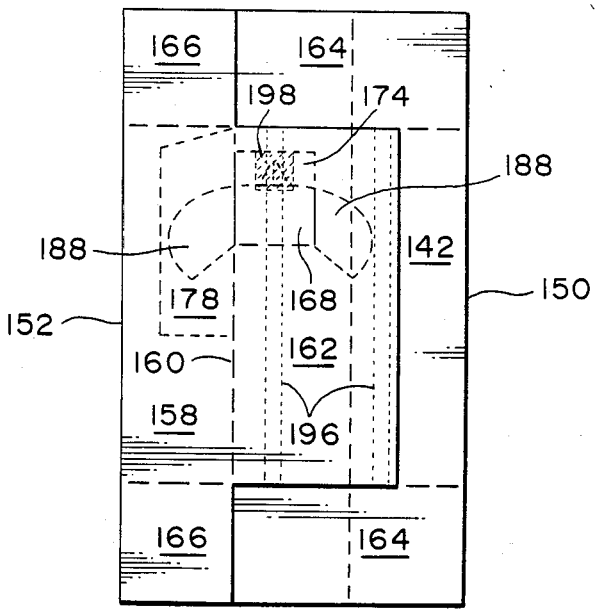
FIG. 12 is a plan view of the folded and tubed blank of the third embodiment.

FIG. 12 is a plan view of the folded carton blank. Side wall 142 is first folded about line 150 in FIG. 11. Thus, it overlaps end wall panel 146 and partially extends over side wall panel 144. Next, end wall panel 158 and attached glue flap 162 are folded about articulation 152 and overlap part of side panel 142 and entirely covers wall extension 178. In this overlapped position, pouring spout tab 168 lies immediately above and contiguous to central part 184 of pouring spout 182 and is glued thereto by the glue on one of strips 196. Likewise, easy access tab 174 is positioned above and surrounding slits 192 but the glue applied thereto does not adhere because of the ink or varnish 198 (shaded area) applied thereto. Thus, when the access tab 174 is removed, it does not stick to the area it covers.

In this folded state, the carton can be shipped to the user thereof who will erect it and by folding inwardly bottom and top panels 164 and 166, a carton of substantially rectangular shape is formed.

Figure 13:
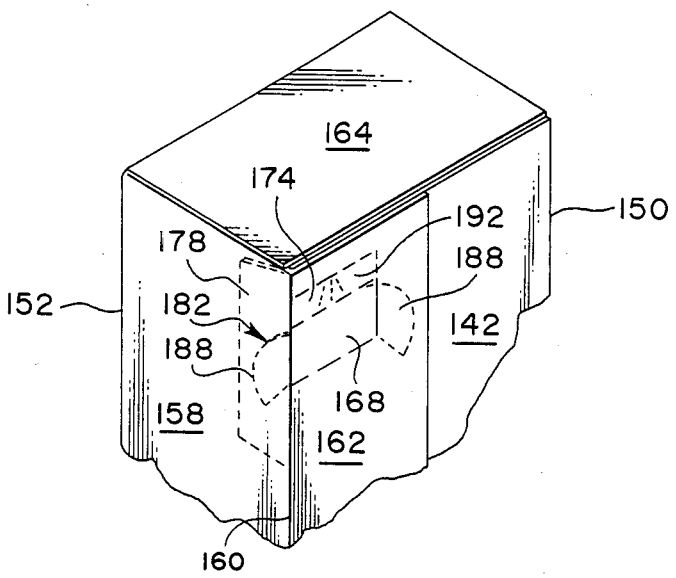
FIG. 13 is a perspective view of the third embodiment illustrating the carton in its fully erected state with the pouring spout closed.

The erected carton is shown in FIG. 13 and shows the carton with the access tab 174 in place and the spout 182 in its closed position and covered with superimposed spout tab 168. Slits 192 are covered by access tab 174. Spout wings 188 are shown in dashed lines in their folded state in side wall 142 and wall extension 178.

Figure 14:
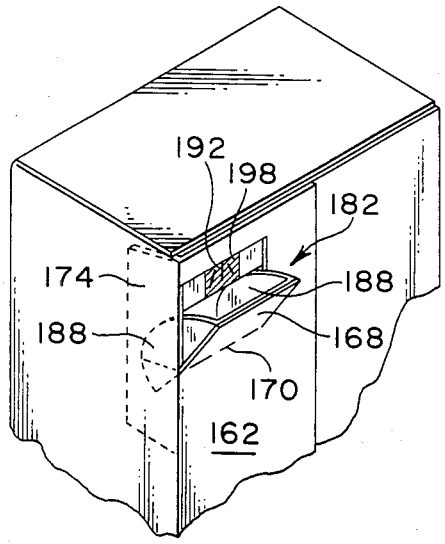
FIG. 14 is a fragmentary perspective view similar to FIG. 13 illustrating the carton of the third embodiment with its spout in a partially opened position.

FIG. 14 is a fragmentary perspective view illustrating the carton with its spout in the open position. In this state, easy access tab 174 has been removed exposing the area in which ink or varnish 198 had been previously applied to prevent glue from adhering thereto. Further, in this area slits 192 can be seen which enable the finger or other object to be inserted into the carton to grasp the top of spout 182 and pull the top thereof out of the carton. As can be seen in FIG. 14, a pouring spout tab 168 is glued to central part 184 of spout 182 which has attached to each side thereof wings or side walls 188 which extend from the bottom to the top of the rectangular opening formed by pouring spout tab 168.

From FIG. 11, it can be seen that pouring spout 182 can be made as large as desired by extending the width of glue panel 196 to the width of side wall panel 142, increasing the base width 170 of the pouring spout tab 168 and expanding the base 186 of pouring spout 182 a corresponding distance into first side wall panel 142. The only limitation is caused by inner wing 188 reaching articulation 150 between end wall panel 146 and side wall panel 142. The inner wing 188 could extend into end wall panel 146 if an inner panel were attached thereto and thus the spout 182 could extend across the entire side wall 142 of carton blank 140.

As is now evident, the novel carton is an improvement over the prior art in that the carton cannot be opened and closed without leaving an indication, the improved spout does not have wings with protruding abutments which cause resistance to opening the spout, the cartons can be manufactured at a much faster rate in that the glue process can be speeded up significantly and the improved carton allows easy opening of the pouring spout without damaging fingernails.

As used herein, the word "tamper-proof" does not mean that there can be no tampering with the carton spout but, instead, means that any tampering with the contents of the carton can be detected merely by observing the outside of the carton in the pouring spout area.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A carton with integral pouring spout comprising:

a. first and second side wall panels, b. first and second end wall panels narrower than said side wall panels and hingedly connected to said first and second side wall panels to form a tubular carton of rectangular cross-section, c. a glued inner panel hingedly connected along an edge of one of said wall panels, said glued inner panel extending in face-to-face relation with one of said first or second side or first or second end wall panels of said carton to define therewith an inner and an outer panel having a dispensing opening with a pouring spout movable from a closed to an open position formed therethrough, said spout having side walls and an end wall tab glued thereto integral with said outer panel, and d. an access tab not adhered to the inner panel located in and integral with said outer panel above and immediately adjacent the upper end of said end wall tab of said pouring spout and removably attached to said outer panel and the upper end of said end wall tab of said pouring spout to prevent opening of said spout until said access tab is detached.

2. A carton as in claim 1 further including:

at least one generally vertically extending slit line in said inner panel immediately under said access tab whereby when said access tab is removed, said slit enables easy access to pull out said pouring spout.

3. A one-piece cardboard carton having an integral pouring spout comprising:

a. first and second side wall panels, b. a first end wall panel hingedly connecting said side wall panels, c. a second end wall panel hingedly connected to the remaining edge of said second side wall panel, d. a glue flap hingedly connected to the remaining edge of said second end wall panel, said glue flap being secured to the outer surface of said first side wall panel to form a body wall of a tubular carton body, e. a generally rectangular pouring spout tab formed in and removably attached along its sides and top to said glue flap, said tab defining a dispensing opening and being hingedly connected at its base to said glue flap, f. a wall extension hingedly connected to the outer side edge of said first side wall panel, said wall extension lying along the inner surface of said second end wall, g. a pouring spout formed in part in said first side wall and in part in said wall extension and movable through said dispensing opening from a closed to an open position, said pouring spout comprising (i) a generally rectangular center part hingedly connected at the base thereof to said first side wall panel and located immediately under and superimposed by said pouring spout tab, and (ii) a wing hingedly attached and extending to each side of said center part into said first side wall panel and said wall extension, each of said wings being generally in the shape of a quarter circle whose unbroken arc extends beyond 90° from the vertical, and so dimensioned as to completely close the opposite sides of said dispensing opening thereby providing a pouring spout with side walls from the top to the bottom of said dispensing opening, h. means for securing said pouring spout tab to said pouring spout center part to form a unitary pouring spout, i. an access tab located above and immediately adjacent to said pouring spout tab and removably attached to said glue flap and said pouring spout tab to prevent opening of said spout until said access tab is removed, and j. at least one generally vertically extending slit in said first side wall panel immediately under said access tab whereby when said access tab is removed, said slit enables easy access to pull out said pouring spout.

4. A one-piece cardboard carton having an integral pouring spout comprising:

a. first and second side wall panels, b. a first end wall panel hingedly connecting said side wall panels, c. a glue flap hingedly connected to the remaining edge of said first side wall panel, d. a second end wall panel hingedly connected to the remaining edge of said second side wall panel, said second end wall panel being secured to the inner surface of said glue flap to form a body wall of a tubular carton body, e. a generally rectangular pouring spout tab formed in and removably attached along its sides and top to said glue flap adjacent the upper end thereof, said tab defining a dispensing opening and being hingedly connected at its base to said glue flap and having one of its side edges lying along the line of articulation between said glue flap and said first side wall, f. a wall extension hingedly connected to the outer side edge of said second end wall panel, said wall extension lying along the inner surface of said first side wall, g. a pouring spout formed in part in said second end wall and in part in said wall extension and movable through said dispensing opening from a closed to an open position, said pouring spout comprising (i) a generally rectangular center part hingedly connected at the base thereof to said second end wall panel and located immediately under and superimposed by said pouring spout tab, and (ii) a wing hingedly attached and extending to each side of said center part into said second end wall panel and said wall extension, each of said wings being generally in the shape of a quarter circle whose unbroken arc extends beyond 90° from the vertical, and so dimensioned as to completely close the opposite sides of said dispensing opening thereby providing a pouring spout with side walls from the top to the bottom of said dispensing opening, h. means for securing said pouring spout tab to said pouring spout center part to form a unitary pouring spout, i. an access tab located above and immediately adjacent to said pouring spout tab and removably attached to said glue flap and said pouring spout tab to prevent opening of said spout until said access tab is removed, and j. at least one generally vertically extending slit in said second end wall panel immediately under said access tab whereby when said access tab is removed, said slit enables easy access to pull out said pouring spout.

5. A one-piece cardboard carton having an integral pouring spout comprising:

a. first and second side wall panels, b. a first end wall panel hingedly connecting said side wall panels, c. a second end wall panel hingedly connected to the remaining edge of said first side wall panel, d. a glue flap hingedly connected to the remaining edge of said second side wall panel, said glue flap being secured to the inner surface of said second end wall panel to form a body wall of a tubular carton body, e. a generally rectangular pouring spout tab formed in and removably attached to said second end wall panel adjacent the upper end thereof, said tab defining a dispensing opening and being hingedly connected at its base to said second end wall, f. a pouring spout formed in said glue flap, said spout being movable through said dispensing opening in said second end wall from a closed to an open position and comprising (i) a generally rectangular center part hingedly connected at the base thereof to said glue flap and located immediately under and superimposed by said pouring spout tab, and (ii) a wing hingedly attached and extending to each side of said center part, each of said wings being generally in the shape of a quarter circle whose outer edge is an unbroken arc that extends beyond 90° from the vertical and so dimensioned as to completely close the opposite sides of dispensing opening thereby providing a pouring spout with side walls from the top to the bottom of said dispensing opening, g. means securing said pouring spout tab to said pouring spout center part to form a unitary pouring spout, h. an access tab located above and immediately adjacent to said pouring spout tab and removably attached to said second end wall and said pouring spout tab to prevent opening of said spout until said access tab is removed, and i. at least one generally vertically extending slit in said glue flap immediately under said access tab whereby when said access tab is removed, said slit enables easy access to pull out said pouring spout.

6. A one-piece cardboard carton blank having an integral pouring spout formed therein comprising:

a. first and second side wall panels, b. a first end wall panel hingedly connecting said side wall panels, c. a glue flap hingedly connected to the remaining edge of said first side wall panel, d. a second end wall panel hingedly connected to the remaining edge of said second side wall panel, said second end wall panel designed to be secured to the inner surface of said glue flap when said blank is folded about its hinge lines to form a body wall of a tubular carton body, e. a generally rectangular pouring spout tab formed in and removably attached along its sides and top to said glue flap adjacent the upper end thereof, said tab defining a dispensing opening and being hingedly connected at its base to said glue flap and having one of its side edges lying along the line of articulation between said glue flap and said first side wall, f. a wall extension hingedly connected to the outer side edge of said second end wall panel, said wall extension designed to lie along the inner surface of said first side wall when said carton is completed, g. a pouring spout formed in part in said second end wall panel and in part in said wall extension and designed to move through said dispensing opening from a closed to an open position when said carton blank is folded to form a carton body, said pouring spout comprising (i) a generally rectangular center part hingedly connected at the base thereof to said second end wall panel and designed to be attached to, while superimposed on, said pouring spout tab when said blank is folded to form a carton body, and (ii) a wing hingedly attached and extending to each side of said center part into said second end wall panel and said wall extension, each of said wings being generally in the shape of a quarter circle whose unbroken arc extends beyond 90° from the vertical, and so dimensioned as to completely close the opposite sides of said opening when said carton blank is folded to form a carton body thereby providing a pouring spout with side walls from the top to the bottom of said dispensing opening, h. an access tab located above and immediately adjacent to said pouring spout tab and removably attached to said glue flap and said pouring spout tab to prevent opening of said spout until said access tab is removed, and i. at least one generally vertically extending slit in said second end wall panel and designed to lie immediately under said access tab whereby when said carton body is formed from said blank and said access tab is removed, said slit enables easy access to pull out said pouring spout.

7. A one-piece cardboard carton blank having an integral pouring spout formed therein comprising:

a. first and second side wall panels, b. a first end wall panel hingedly connecting said side wall panels, c. a second end wall panel hingedly connected to the remaining edge of said first side wall panel, d. a glue flap hingedly connected to the remaining edge of said second side wall panel, said glue flap being designed to be secured to the inner surface of said second end wall panel when said blank is folded about its hinge lines to form a body wall of a tubular carton body, e. a generally rectangular pouring spout tab formed in and removably attached along its sides and top to said second end wall panel adjacent the upper end thereof, said tab defining a dispensing opening and being hingedly connected at its base to said second end wall, f. a pouring spout formed in said glue flap, said spout being movable through said dispensing opening in said second end wall from a closed to an open position when said carton blank is folded to form a carton body, said spout comprising (i) a generally rectangular center part hingedly connected at the base thereof to said glue flap and designed to be located immediately under and superimposed by said pouring spout tab when said blank is folded to form a carton body, and (ii) a wing hingedly attached and extending to each side of said center part, each of said wings being generally in the shape of a quarter circle whose outer edge is an unbroken arc that extends beyond 90° from the vertical, and so dimensioned as to completely close the opposite sides of said dispensing opening when said blank is folded to form a carton body thereby providing a pouring spout with side walls from the top to the bottom of said dispensing opening, g. an access tab located above and immediately adjacent to said pouring spout tab and removably attached to said second end wall and said pouring spout tab to prevent opening of said spout when said carton body is formed until said access tab is removed, and h. at least one generally vertically extending slit in said glue flap immediately under said access tab whereby when said carton body is formed from said blank and said access tab is removed, said slit enables easy access to pull out said pouring spout.

* * * * *